US009693171B2

(12) United States Patent
Fukue et al.

(10) Patent No.: US 9,693,171 B2
(45) Date of Patent: Jun. 27, 2017

(54) SOUND FIELD MEASURING DEVICE, METHOD, AND PROGRAM

(71) Applicant: CLARION CO., LTD., Saitama-shi (JP)

(72) Inventors: Kazutomo Fukue, Saitama (JP); Takeshi Hashimoto, Motomiya (JP); Tetsuo Watanabe, Hasuda (JP); Yasuhiro Fujita, Kashiwa (JP)

(73) Assignee: CLARION CO., LTD., Saitama-Shi (JP)

( * ) Notice: Subject to any disclaimer, the term of this patent is extended or adjusted under 35 U.S.C. 154(b) by 0 days.

(21) Appl. No.: 15/026,252

(22) PCT Filed: Sep. 22, 2014

(86) PCT No.: PCT/JP2014/075060
§ 371 (c)(1),
(2) Date: Mar. 31, 2016

(87) PCT Pub. No.: WO2015/053068
PCT Pub. Date: Apr. 16, 2015

(65) Prior Publication Data

US 2016/0241985 A1 Aug. 18, 2016

(30) Foreign Application Priority Data

Oct. 7, 2013 (JP) ..... 2013-209895

(51) Int. Cl.
*H04S 7/00* (2006.01)
*H04R 3/04* (2006.01)

(52) U.S. Cl.
CPC ..... *H04S 7/307* (2013.01); *H04R 3/04* (2013.01); *H04S 7/301* (2013.01);
(Continued)

(58) Field of Classification Search
None
See application file for complete search history.

(56) References Cited

U.S. PATENT DOCUMENTS 6,377,862 B1 * 4/2002 Naruki ..... H04S 1/007 381/104
6,453,253 B1 * 9/2002 Ito ..... G01H 3/005 381/59

(Continued)

FOREIGN PATENT DOCUMENTS

JP 63-186300 8/1988
JP 07-075190 3/1995

(Continued)

OTHER PUBLICATIONS

International Search Report for corresponding International Application No. PCT/JP2014/075060, Nov. 4, 2014.

(Continued)

*Primary Examiner* — Curtis Kuntz
*Assistant Examiner* — Qin Zhu
(74) *Attorney, Agent, or Firm* — Mori & Ward, LLP

(57) ABSTRACT

A sound field measuring device (1) includes an external output unit (6) configured to output a measurement signal composed of a periodic function having a code length of $2^n-1$ (n is a natural number) to a speaker (9), a microphone (7) configured to pick up the measurement signal outputted from the speaker (9), a Fourier transform unit (12) configured to obtain frequency characteristics by Fourier transforming measurement sound picked up with a sample length of $2^m$ (m is a natural number), a thinning-out unit (13) configured to remove line spectra except for the $(k\times2^{m-n}+1)$th line spectra (k=0, 1, 2, and the like) from the obtained frequency characteristics, and an averaging unit (14) configured to obtain averaged frequency characteristics of a (Continued)

sound field on the basis of frequency characteristics thinned-out.

6 Claims, 13 Drawing Sheets

(52) U.S. Cl.
CPC ..... *H04S 2400/09* (2013.01); *H04S 2400/13* (2013.01); *H04S 2400/15* (2013.01); *H04S 2420/07* (2013.01)

(56) References Cited

U.S. PATENT DOCUMENTS 8,090,120 B2 * 1/2012 Seefeldt ..... H03G 3/32 381/104
2004/0240676 A1 * 12/2004 Hashimoto ..... H04R 5/02 381/56
2008/0189065 A1 8/2008 Asada et al.
2009/0193895 A1 * 8/2009 Date ..... G01H 17/00 73/579
2009/0220100 A1 * 9/2009 Ohta ..... G10K 15/08 381/63
2012/0063605 A1 3/2012 Tawada

FOREIGN PATENT DOCUMENTS

JP 2000-069597 3/2000
JP 2007-232492 9/2007
JP 2008-191005 8/2008
JP 2012-058701 3/2012

OTHER PUBLICATIONS

Chinese Office Action for corresponding CN Application No. 201480053301.9, Oct. 28, 2016.

* cited by examiner

SOUND FIELD MEASURING DEVICE, METHOD, AND PROGRAM

TECHNICAL FIELD

The present invention relates to a sound field measuring device, method, and program. More specifically, the invention relates to a sound field measuring device, method, and program that can effectively measure the frequency characteristics of a sound field environment using a measurement signal composed of a periodic function having a code length of $2^n-1$ (n is a natural number).

BACKGROUND ART

There has been known a method of providing music having sound quality most suitable for a sound field environment in which speakers or the like of an audio system are installed, by measuring frequency characteristics of the sound field environment and adjusting the equalizer of the audio system on the basis of the measured frequency characteristics or by previously correcting output sound in accordance with the sound field.

A pseudorandom noise (PN) code and a time stretched pulse (TSP) signal are known as measurement signals for measuring frequency characteristics. Typically, a PN code is an artificial measurement signal composed of random noise. Examples of a PN code include a maximum length sequence (m-sequence) code and a Gold sequence code.

Both an m-sequence code and a Gold sequence code are generated by performing feedback using a predetermined shift register and an exclusive OR. If the length (stage number) of a shift register is n (n is a natural number), the period of the code (code length) is $2^n-1$. The feedback position of the shift register is obtained using a generating polynomial. If an m-sequence code is used as an output signal, the output signal is a binary sequence composed of 0s and 1s and is a signal including many direct-current components and therefore is subjected to the conversion of 0s into −1s and then outputted. As seen above, a measurement signal composed of a periodic function having a code length of $2^n-1$ is used to measure the frequency characteristics of a sound field.

Examples of a method for measuring the frequency characteristics of a sound field environment using such a measurement signal include a method including picking up a measurement signal outputted from a speaker using a microphone installed in the listening position and then Fourier transforming the picked-up signal to obtain the frequency characteristics (for example, see Patent Literatures 1, 2). An impulse response may be obtained by obtaining cross-correlation characteristics between an outputted measurement signal and the measurement signal picked up using a microphone while using the outputted measurement signal as a reference.

CITATION LIST

Patent Literature

PTL 1: Japanese Unexamined Patent Application Publication No. 07-075190

PTL 2: Japanese Unexamined Patent Application Publication No. 2007-232492

SUMMARY OF INVENTION

Technical Problem

As described above, if a measurement signal composed of a periodic function having a code length of $2^n-1$ is used to measure the frequency characteristics of a sound field, it is necessary to Fourier transform measurement sound picked up using a microphone. In performing a Fourier transform process, the Fourier transform sample length is often set to twice or more the code length of the measurement signal. By setting the sample length to twice or more the code length, it is possible to suppress variations in the amplitude spectra at each Fourier transform and to obtain approximately uniform frequency characteristics.

Typically, the Fourier transform sample length is $2^m$ (m is a natural number; m>n), whereas the code length of a measurement signal is $2^n-1$. For this reason, when frequency characteristics are obtained using such a measurement signal, the Fourier transform sample length tends not to be an integral multiple of the code length of the measurement signal, that is, tends to be asynchronous therewith. When the Fourier transform sample length is asynchronous with the code length of the measurement signal, there is caused a problem that low-level, varying line spectra occur among the obtained uniform line spectra and are detected as noise.

However, even when a measurement signal composed of a periodic function having a code length of $2^n-1$ is used, if the measurement signal has a long code length, variations in the amplitude spectra can be reduced. For example, FIG. 12(*a*) shows frequency characteristics obtained when an m-sequence code having a length of 32,767 was used, and FIG. 12(*b*) shows frequency characteristics obtained when a logarithmic averaging process was performed with a ⅓ octave bandwidth. While the use of the long m-sequence code caused differences among the signal levels of the amplitude spectra, approximately uniform frequency characteristics could be obtained by performing the logarithmic averaging process.

As seen above, when a measurement signal having a long code length is used, a large number of amplitude spectra are produced by performing Fourier transform, that is, line spectra are produced at short frequency intervals. Accordingly, noise can be reduced by performing an averaging process. However, use of a measurement signal having a long code length disadvantageously increases the amount of memory or the like required to perform Fourier transform or the like, as well as increases the required processing time or processing load.

On the other hand, use of a measurement signal having a short code length can reduce the amount of memory required to perform Fourier transform, as well as can reduce the processing time or processing load. FIG. 13 includes diagrams showing frequency characteristics obtained using a measurement signal having a short code length. FIG. 13(*a*) shows frequency characteristics obtained using an m-sequence code having a length of 4,096, and FIG. 13(*b*) shows frequency characteristics obtained by performing a logarithmic averaging process with a ⅓ octave bandwidth. Use of a measurement signal having a short code length can reduce the measurement time or measurement load, as well as can reduce the amount of memory used. However, reducing the code length disadvantageously widens the frequency intervals between the amplitude spectra, as shown in FIG. 13(*a*).

Even when a logarithmic averaging process is performed, there occurs a problem that the signal level varies with respect to the frequency characteristics. FIG. 13(*b*) shows a case in which a logarithmic averaging process was performed with a ⅓ octave bandwidth in accordance with human auditory characteristics and shows that the signal level significantly varied in the low-mid range.

As seen above, when a measurement signal composed of a periodic function having a code length of $2^n-1$ is used to measure the frequency characteristics of a sound field, there occur a problem that low varying noise occurs due to the Fourier transform process and it is not easy to effectively measure the frequency characteristics.

The present invention has been made in view of the above problems, and an object thereof is to provide a sound field measuring device, method, and program that can effectively measure the frequency characteristics of a sound field environment using a measurement signal composed of a periodic function having a code length of $2^n-1$.

Solution to Problem

To solve the above problems, a sound field measuring device according to the present invention includes an external output unit configured to output a measurement signal composed of a periodic function having a code length of $2^n-1$ to a speaker so that the measurement signal is outputted from the speaker, a microphone configured to pick up the measurement signal outputted from the speaker, a Fourier transform unit configured to obtain frequency characteristics by Fourier transforming measurement sound picked up by the microphone with a sample length of $2^m$, a thinning-out unit configured to remove noise from the frequency characteristics obtained by the Fourier transform unit by removing line spectra except for the $(k\times2^{m-n}+1)$th line spectra from the frequency characteristics, and an averaging unit configured to obtain averaged frequency characteristics of a sound field by calculating an average value of signal levels in a predetermined frequency range on the basis of frequency characteristics thinned out by the thinning-out unit while shifting the frequency range in steps of a shorter frequency range than the frequency range. n and m are each a natural number satisfying m>n, and k is k=0, 1, 2, and the like.

A method for measuring a sound field using a sound field measuring device according to the present invention includes an external output step in which an external output unit outputs a measurement signal composed of a periodic function having a code length of $2^n-1$ to a speaker so that the measurement signal is outputted from the speaker, a sound pick-up step in which the measurement signal outputted from the speaker in the external output step is picked up using a microphone, a Fourier transform step in which a Fourier transform unit obtains frequency characteristics by Fourier transforming measurement sound picked up using the microphone in the sound pick-up step with a sample length of $2^m$, a thinning-out step in which a thinning-out unit removes noise from the frequency characteristics obtained in the Fourier transform step by removing line spectra except for the $(k\times2^{m-n}+1)$th line spectra from the frequency characteristics, and an averaging step in which an averaging unit obtains averaged frequency characteristics of a sound field by calculating an average value of signal levels in a predetermined frequency range on the basis of frequency characteristics thinned out in the thinning-out step while shifting the frequency range in steps of a shorter frequency range than the frequency range. n and m are each a natural number satisfying m>n, and k is k=0, 1, 2, and the like.

A sound field measuring program executed by a sound field measuring device according to the present invention is a sound field measuring program executed by a sound field measuring device for measuring frequency characteristics of a sound field using a measurement signal composed of a periodic function having a code length of $2^n-1$. The program causes a computer of the sound field measuring device to perform an external output function of outputting a measurement signal composed of a periodic function having a code length of $2^n-1$ to a speaker so that the measurement signal is outputted from the speaker, a sound pick-up function of picking up the measurement signal outputted from the speaker by the external output function using a microphone, a Fourier transform function of obtaining frequency characteristics by Fourier transforming measurement sound picked up by the sound pick-up function with a sample length of $2^m$, a thinning-out function of removing noise from the frequency characteristics obtained by the Fourier transform function by removing line spectra except for the $(k\times2^{m-n}+1)$th line spectra from the frequency characteristics, and an averaging function of obtaining averaged frequency characteristics of a sound field by calculating an average value of signal levels in a predetermined frequency range on the basis of frequency characteristics thinned out by the thinning-out function while shifting the frequency range in steps of a shorter frequency range than the frequency range. n and m are each a natural number satisfying m>n, and k is k=0, 1, 2, and the like.

When a measurement signal composed of a periodic function having a code length of $2^n-1$ is outputted from the speaker or the like and a picked-up signal is Fourier transformed with a sample number of $2^m$, the length (sample length) of Fourier transform is not an integral multiple of the code length of the measurement signal. When the Fourier transform length is not an integral multiple of the code length of the measurement signal, that is, the Fourier transform length is asynchronous therewith, low-level varying line spectra may occur among uniform line spectra at each Fourier transform. These low-level, varying line spectra may act as noise in detected frequency characteristics.

For this reason, the sound field measuring device, method, and program according to the present invention remove line spectra except for $(k\times2^{m-n}+1)$th line spectra from the frequency characteristics obtained by the Fourier transform process. Thus, it is possible to effectively remove noise generated in the frequency characteristics. As seen above, even when the Fourier transform length and the code length of the measurement signal become asynchronous and low-level, varying line spectra occur as noise in the frequency characteristics, it is possible to remove the noise by a thinning-out process and thus to improve the measurement accuracy of the frequency characteristics of the sound field.

As described above, use of a measurement signal having a short code length can reduce the processing load or processing time required to measure frequency characteristics, as well as can reduce the amount of memory required for processing. However, use of such a measurement signal disadvantageously widens the frequency intervals between the detected line spectra in the low-mid range and causes variations in the line spectra. Accordingly, a measurement signal having a short code length involves a problem that it is not easy to measure frequency characteristics with a sufficient degree of measurement accuracy.

On the other hand, the sound field measuring device, method, and program according to the present invention can remove low-level, varying line spectra by a thinning-out process even when the frequency intervals between the line spectra is widened. Thus, it is possible to obtain the frequency characteristics in the low-mid range with a sufficient degree of measurement accuracy.

A sound field measuring device according to the present invention includes an external output unit configured to output a measurement signal composed of a periodic function having a code length of $2^n-1$ to a speaker so that the measurement signal is outputted from the speaker, a microphone configured to pick up the measurement signal outputted from the speaker, a Fourier transform unit configured to obtain frequency characteristics by Fourier transforming measurement sound picked up by the microphone with a sample length of $2^m$, a range division unit configured to generate first frequency characteristics composed of high-range components and second frequency characteristics composed of low-range components by dividing a range of the frequency characteristics obtained by the Fourier transform unit, a thinning-out unit configured to remove noise from the second frequency characteristics generated by the range division unit by removing line spectra except for the $(k\times2^{m-n}+1)$th line spectra from the second frequency characteristics, a first averaging unit configured to generate averaged first frequency characteristics by calculating an average value of signal levels in a predetermined first frequency range on the basis of the first frequency characteristics generated by the range division unit while shifting the first frequency range in steps of a shorter frequency range than the first frequency range, a second averaging unit configured to generate averaged second frequency characteristics by calculating an average value of signal levels in a predetermined second frequency range on the basis of the second frequency characteristics thinned out by the thinning-out unit while shifting the second frequency range in steps of a shorter frequency range than the second frequency range, and a combination unit configured to obtain frequency characteristics of a sound field including signal components in all ranges by combining the first frequency characteristics averaged by the first averaging unit and the second frequency characteristics averaged by the second averaging unit. n and m are each a natural number satisfying m>n, and k is k=0, 1, 2, and the like.

A method for measuring a sound field using a sound field measuring device according to the present invention includes an external output step in which an external output unit outputs a measurement signal composed of a periodic function having a code length of $2^n-1$ to a speaker so that the measurement signal is outputted from the speaker, a sound pick-up step in which the measurement signal outputted from the speaker in the external output step is picked up using a microphone, a Fourier transform step in which a Fourier transform unit obtains frequency characteristics by Fourier transforming measurement sound picked up using the microphone in the sound pick-up step with a sample length of $2^m$, a range division step in which a range division unit generates first frequency characteristics composed of high-range components and second frequency characteristics composed of low-range components by dividing a range of the frequency characteristics obtained in the Fourier transform step, a thinning-out step in which a thinning-out unit removes noise from the second frequency characteristics generated in the range division step by removing line spectra except for the $(k\times2^{m-n}+1)$th line spectra from the second frequency characteristics, a first averaging step in which a first averaging unit generates averaged first frequency characteristics by calculating an average value of signal levels in a predetermined first frequency range on the basis of the first frequency characteristics generated in the range division step while shifting the first frequency range in steps of a shorter frequency range than the first frequency range, a second averaging step in which a second averaging unit generates averaged second frequency characteristics by calculating an average value of signal levels in a predetermined second frequency range on the basis of the second frequency characteristics thinned out in the thinning-out step while shifting the second frequency range in steps of a shorter frequency range than the second frequency range, and a combination step in which a combination unit obtains frequency characteristics of a sound field including signal components in all ranges by combining the first frequency characteristics averaged in the first averaging step and the second frequency characteristics averaged in the second averaging step. n and m are each a natural number satisfying m>n, and k is k=0, 1, 2, and the like.

A sound field measuring program executed by a sound field measuring device according to the present invention is a sound field measuring program executed by a sound field measuring device for measuring frequency characteristics of a sound field using a measurement signal composed of a periodic function having a code length of $2^n-1$. The program causes a computer of the sound field measuring device to perform an external output function of outputting a measurement signal composed of a periodic function having a code length of $2^n-1$ to a speaker so that the measurement signal is outputted from the speaker, a sound pick-up function of picking up the measurement signal outputted from the speaker by the external output function, a Fourier transform function of obtaining frequency characteristics by Fourier transforming measurement sound picked up by the sound pick-up function with a sample length of $2^m$, a range division function of generating first frequency characteristics composed of high-range components and second frequency characteristics composed of low-range components by dividing a range of the frequency characteristics obtained by the Fourier transform function, a thinning-out function of removing noise from the second frequency characteristics generated by the range division function by removing line spectra except for the $(k\times2^{m-n}+1)$th line spectra from the second frequency characteristics, a first averaging function of generating averaged first frequency characteristics by calculating an average value of signal levels in a predetermined first frequency range on the basis of the first frequency characteristics generated by the range division function while shifting the first frequency range in steps of a shorter frequency range than the first frequency range, a second averaging function of generating averaged second frequency characteristics by calculating an average value of signal levels in a predetermined second frequency range on the basis of the second frequency characteristics thinned out by the thinning-out function while shifting the second frequency range in steps of a shorter frequency range than the second frequency range, and a combination function of obtaining frequency characteristics of a sound field including signal components in all ranges by combining the first frequency characteristics averaged by the first averaging function and the second frequency characteristics averaged by the second averaging function. n and m are each a natural number satisfying m>n, and k is k=0, 1, 2, and the like.

The sound field measuring device, method, and program according to the present invention divide frequency characteristics obtained by a Fourier transform process into first frequency characteristics composed of high-range components and second frequency characteristics composed of low-range components and then thin out only the second frequency characteristics of the low range. Thus, it is possible to avoid reductions in the signal levels of the high-range components which may result from the thinning-out process.

Low-level, varying line spectra, which result from the asynchronicity between the Fourier transform length and the code length of the measurement signal, are more likely to be determined to be noise in the low-mid range due also to the wide frequency intervals between the line spectra in the low-mid range. For this reason, the second frequency characteristics of the low range are thinned out. Thus, it is possible to effectively reduce the noise of the low-range components.

Since the first frequency characteristics of the high range are not thinned out, it is possible to avoid reductions in the signal levels of the high-range components which may result from the thinning-out process. This eliminates the need to amplify the high-range components. Further, by combining averaged first frequency characteristics and averaged second frequency characteristics and thus generating frequency characteristics including signal components in all ranges, it is possible to more accurately obtain frequency characteristics of the sound field.

Advantageous Effects of Invention

The sound field measuring device, method, and program according to the present invention can remove low-level, varying line spectra by a thinning-out process even when the frequency intervals between the line spectra is widened. Thus, it is possible to obtain the frequency characteristics in the low-mid range with a sufficient degree of measurement accuracy.

BRIEF DESCRIPTION OF DRAWINGS

FIG. 9(*b*) shows the frequency characteristics of the signal averaged by the averaging unit without being thinning out;

FIG. 10(*b*) shows the frequency characteristics of a signal which was not thinned out;

FIG. 12(*b*) shows frequency characteristics when a logarithmic averaging process was performed with a ⅓ octave bandwidth; FIG. 13(*b*) shows frequency characteristics when a logarithmic averaging process was performed with a ⅓ octave bandwidth.

DESCRIPTION OF EMBODIMENTS

Figure 1:
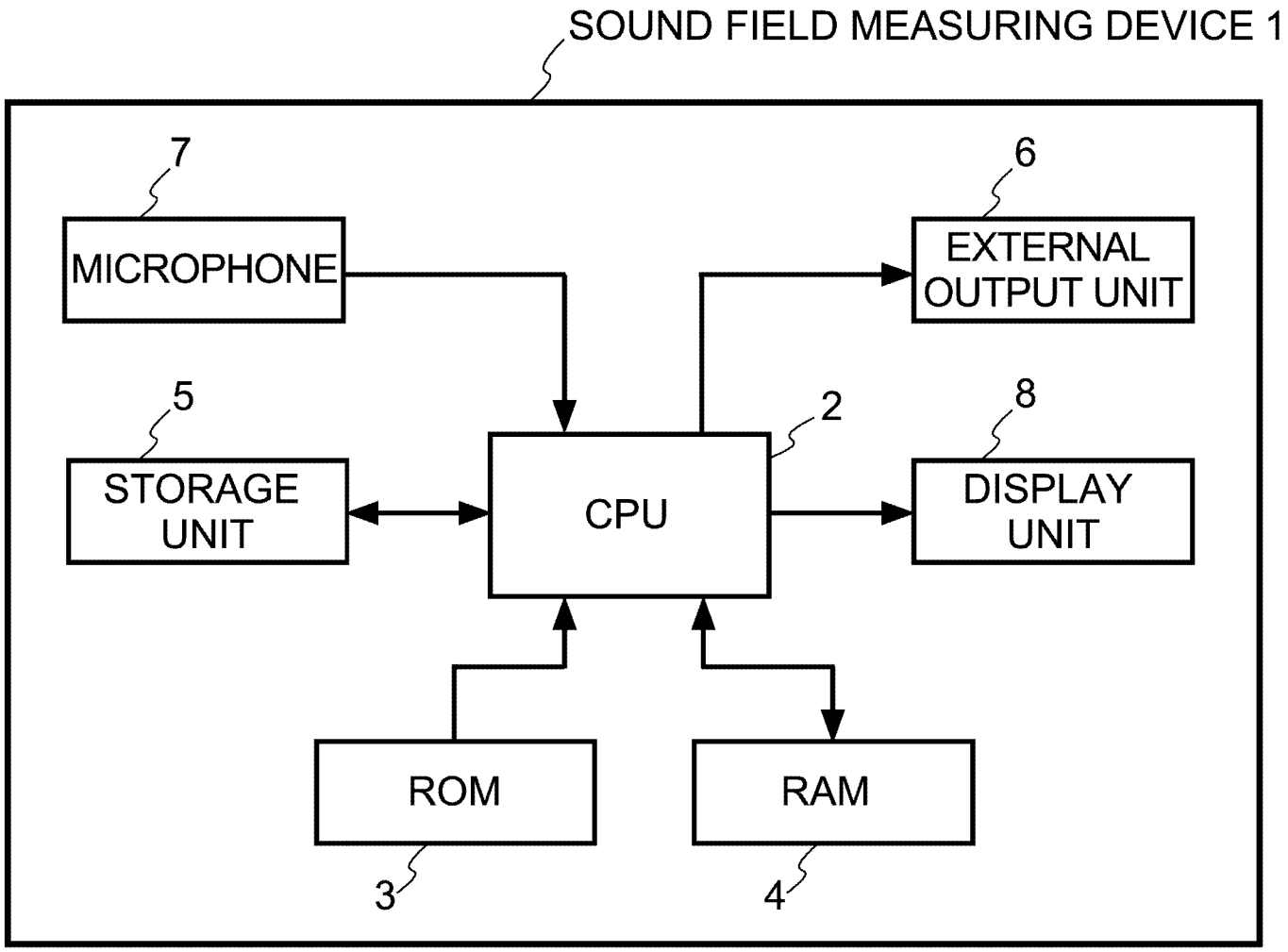
FIG. 1 is a block diagram showing a first schematic hardware configuration of a sound field measuring device according to an embodiment.

Hereafter, a sound field measuring device according to the present invention will be described in detail with reference to the drawings. FIG. 1 is a block diagram showing an example schematic hardware configuration of the sound field measuring device according to the present invention. As shown in FIG. 1, a sound field measuring device 1 includes a CPU 2, a read only memory (ROM) 3, a random access memory (RAM) 4, a storage unit 5, an external output unit 6, a microphone 7, and a display unit 8. The external output unit 6 is connected to a speaker 9 (see FIG. 2).

The ROM 3 is storing a processing program and the like executed by the sound field measuring device 1. For example, when the CPU 2 reads the processing program or the like in the ROM 3 on startup of the sound field measuring device 1 or in response to a user operation, the sound field measuring device 1 performs various types of processing such as the measurement of frequency characteristics. The RAM 4 is used as a work area or the like for processing performed by the CPU 2.

The storage unit 5 is so-called auxiliary storage and is typically in the form of a hard disk, solid state drive (SSD), non-volatile memory (e.g., flash ROM, flash memory), or the like. A removable memory card such as an SD card may be used as the storage unit 5. The storage unit 5 stores various types of data or the like used in various types of processing performed by the CPU 2.

If an information mobile terminal such as a smartphone is used as the sound field measuring device 1, an application program obtained by download or the like may be recorded in the storage unit 5. The sound field measuring device 1 can measure frequency characteristics on the basis of this application program.

The external output unit 6 has a function of outputting a measurement signal (to be discussed later) from the speaker 9. The external output unit 6 includes devices or the like necessary to output a measurement signal from the speaker 9. For example, the external output unit 6 includes a D/A converter that converts a measurement signal into an analog signal and an amplifier that amplifies the output of the measurement signal. The external output unit 6 also includes an external output terminal or the like which can be connected to an input terminal of the speaker 9 through an audio cable.

The external output unit 6 need not be physically connected to the speaker 9 using an audio cable or the like. For example, the external output unit 6 may be configured to output a measurement signal from the speaker 9 using a wireless technology such as the Bluetooth® or a wireless LAN.

The microphone 7 has a function of picking up measurement sound outputted from the speaker 9. The measurement sound picked up by the microphone 7 is recorded in the RAM 4 or storage unit 5 and used in a frequency characteristics measurement process (to be discussed laser). The display unit 8 is typically in the form of a liquid crystal display, cathode-ray tube (CRT) display, or the like. The display unit 8 has a function of displaying the frequency characteristics of the sound field (e.g., frequency characteristics shown in FIGS. 8 to 10 (to be discussed later)) obtained by the frequency characteristics measurement process so that the user can visually recognize the frequency characteristics.

Figure 2:
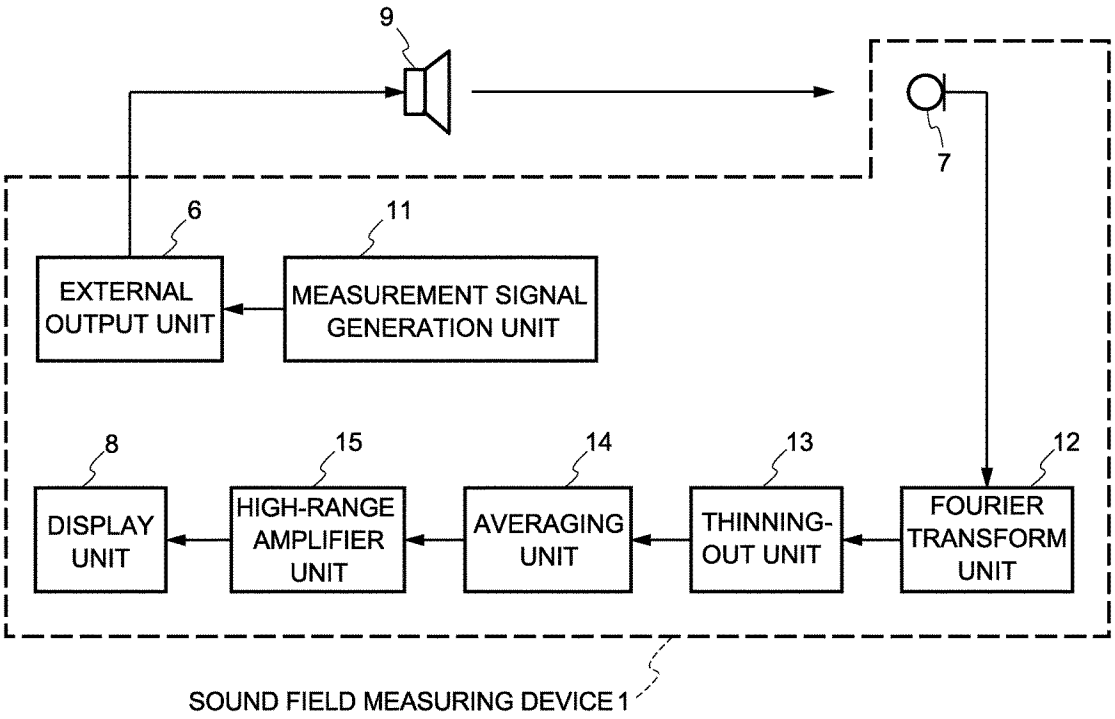
FIG. 2 is a block diagram showing a schematic configuration of the function elements of the sound field measuring device when a CPU according to the embodiment measures frequency characteristics on the basis of a processing program.
Figure 3:
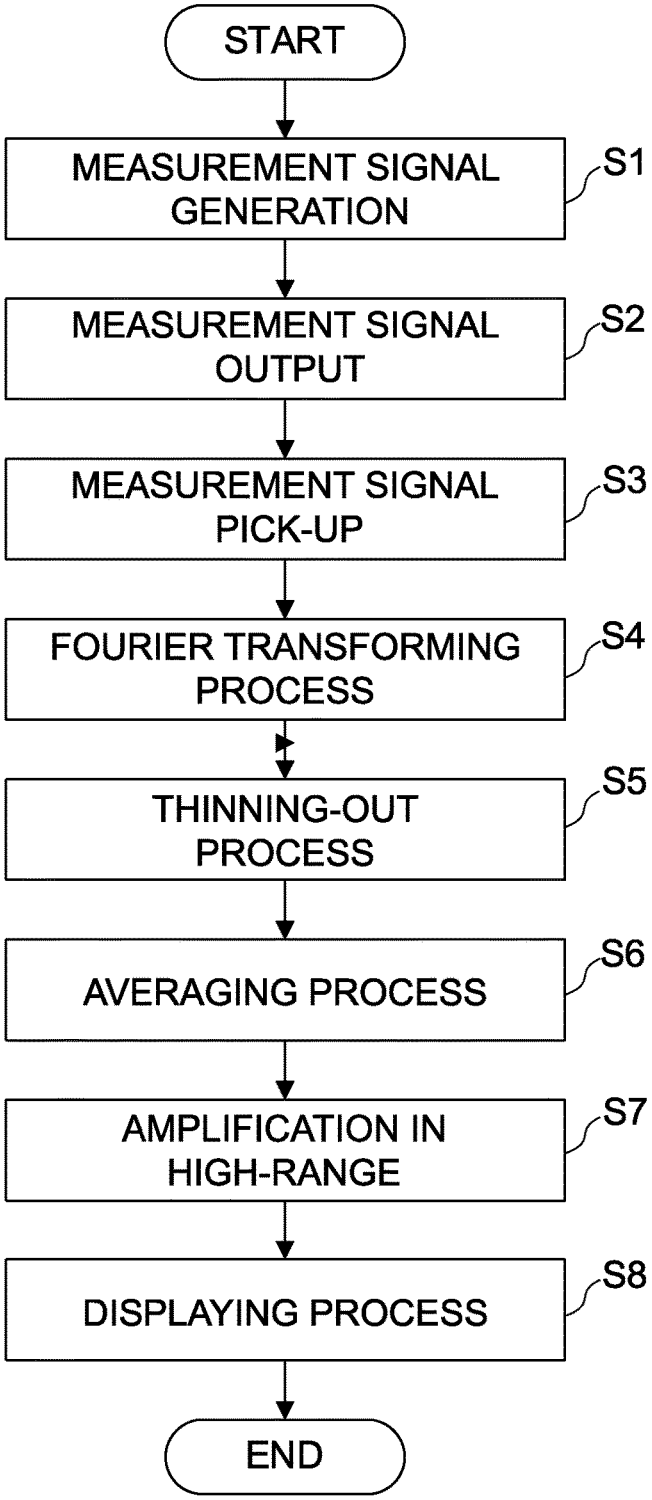
FIG. 3 is a flowchart showing a frequency characteristics measurement process performed by the CPU according to the embodiment.

The CPU 2 has a function of measuring the frequency characteristics between the speaker 9 and microphone 7 in accordance with the processing program stored in the ROM 3 or an application program for measuring frequency characteristics stored in the storage unit 5. FIG. 2 is a block diagram showing a schematic configuration of the function elements of the sound field measuring device 1 when the CPU 2 measures the frequency characteristics on the basis of the processing program or application program. FIG. 3 is a flowchart showing processes performed by the CPU 2 on the basis of the processing program or the like.

As shown in FIG. 2, the sound field measuring device 1 includes a measurement signal generation unit 11, a Fourier transform unit 12, a thinning-out unit 13, an averaging unit 14, a high-range amplifier unit 15, the external output unit 6, the microphone 7, and the display unit 8. FIG. 2 also shows the speaker 9 connected to the external output unit 6. The external output unit 6, microphone 7, and display unit 8 have been described with reference to FIG. 1 and therefore will not be described.

The measurement signal generation unit 11 generates an m-sequence code serving as a measurement signal using any generating polynomial. As described above, an m-sequence code is composed of a periodic function having a code length of $2^n-1$. In $2^n-1$ representing the code length, n is a natural number.

The CPU 2 serves as the measurement signal generation unit 11 in accordance with the processing program or the like and generates a measurement signal composed of an m-sequence code (S1 in FIG. 3). The CPU 2 outputs the generated m-sequence code to the speaker 9 using the external output unit 6 (S2 in FIG. 3; external output step; external output function). The CPU 2 causes the microphone 7 to pick up measurement sound outputted from the speaker 9 (S3 in FIG. 3; sound pick-up step; sound pick-up function). The picked-up measurement sound signal (measurement signal) is outputted to the Fourier transform unit 12.

The Fourier transform unit 12 has a function of performing Fourier transform (fast Fourier transform (FFT)) on the picked-up measurement signal. In the Fourier transform unit 12, the CPU 2 weights the picked-up measurement signal using a window function and then Fourier transforms the resulting signal. In this Fourier transform process, the CPU 2 converts the time-domain measurement signal into a frequency-domain signal and outputs line spectra at each Fourier transform (S4 in FIG. 3; Fourier transform step; Fourier transform function). As used herein, a line spectrum refers to a power spectrum. The number of line spectra is half the Fourier transform sample length. The Fourier transformed measurement signal is outputted to the thinning-out unit 13.

The thinning-out unit 13 has a function of removing line spectra acting as noise from the line spectra of the obtained frequency characteristics. As described above, the length of an m-sequence code is $2^n-1$. On the other hand, the number of the line spectra obtained by the Fourier transform process is $\frac{1}{2}\cdot 2^m$ (m is a natural number), and the Fourier transform length (the sample length of Fourier transform) is $2^m$. Typically, in picking up and Fourier transforming a measurement signal composed of an m-sequence code, the Fourier transform length is set to twice or more the length of the m-sequence code (i.e., m>n). However, the length of the m-sequence code is $2^n-1$ and therefore the Fourier transform length does not become an integral multiple (e.g., twice, four times, eight times) of the length of the m-sequence code. When the Fourier transform length is not an integral multiple of the length of the m-sequence code, that is, it is asynchronous therewith, low-level, varying line spectra occur among the uniform line spectra at each Fourier transform. These low-level, varying line spectra may act as noise in detecting frequency characteristics. For this reason, the thinning-out unit 13 has a function of removing the line spectra acting as noise to remove noise from the frequency characteristics and to improve measurement accuracy.

Figure 4A:
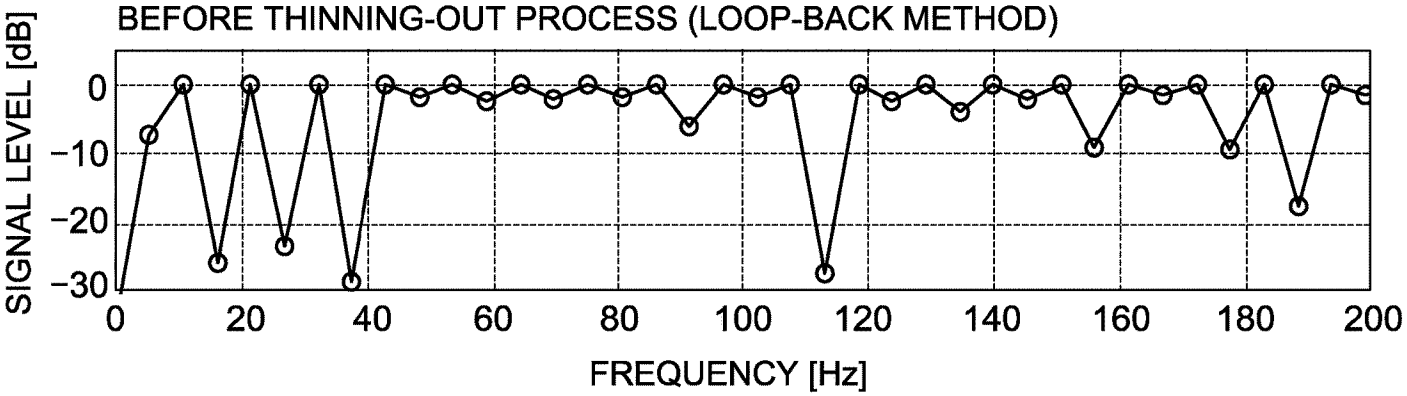
FIG. 4(*a*) shows a first example of frequency characteristics before a thinning-out unit according to the embodiment performs a thinning-out process, and FIG. 4(*b*) shows a first example of frequency characteristics after the thinning-out unit performs the thinning-out process.
Figure 4B:
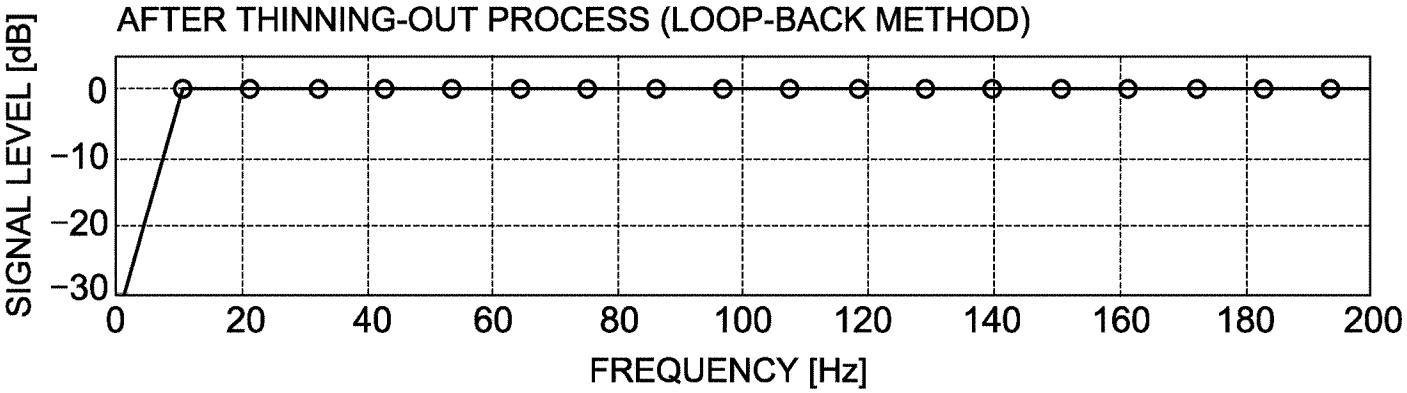

Next, a thinning-out process performed by the thinning-out unit 13 will be described in detail. FIG. 4 includes diagrams showing line spectra (frequency characteristics) that the Fourier transform unit 12 obtained by Fourier transforming an m-sequence code having a length of 4,095 (n=12 in $2^n-1$) serving as a measurement signal using a loop-back method with the Fourier transform length set to 8,192 (m=13 in $2^m$). FIG. 4(*a*) shows frequency characteristics before the thinning-out unit 13 performed a thinning-out process; FIG. 4(*b*) shows frequency characteristics after the thinning-out unit 13 performed the thinning-out process.

As used herein, the term "loop-back method" refers to a method of measuring frequency characteristics by outputting a measurement signal from the external output unit 6 directly to the Fourier transform unit 12 while regarding it as a signal picked up by the microphone 7. By using the loop-back method, it is possible to show the frequency characteristics of a measurement signal which has been Fourier transformed directly without being affected by the sound field. Specifically, by Fourier transforming an m-sequence code serving as a measurement signal using the loop-back method, it is possible to obtain ideal flat frequency characteristics and thus to easily identify noise or the like in the measurement process.

The thinning-out unit 13 sequentially removes line spectra except for $(0\times 2^{m-n}+1)$th, $(1\times 2^{m-n}+1)$th, $(2\times 2^{m-n}+1)$th, (3×

$2^{m-n}+1$)th, . . . and ($k\times2^{m-n}+1$)th line spectra from the line spectra generated by the Fourier transform unit 12, starting from low-range line spectra. As used herein, a variable k is an integer that increments by one, such as k=0, 1, 2, 3, and the like. $k\times2^{m-n}+1$ is a value (the ordinal rank of the last line spectrum≤$k\times2^{m-n}+1$) including the last line spectrum (the last line spectrum in the high range) generated by Fourier transform.

Referring to FIGS. 4(*a*) and 4(*b*), n of the m-sequence code length is 12 (n=12), and m of the Fourier transform length is 13 (m=13). Therefore, $2^{m-n}=2^{13-12}=2^1=2$. Accordingly, the thinning-out unit 13 removes line spectra except for the (0×2+1)th, (1×2+1)th, (2×2+1)th, and (3×2+1)th line spectra, and the like in FIG. 4(*a*), that is, except for the 1st, 3rd, 5th, 7th, and 9th line spectra and the like, starting from low-range line spectra. In other words, the thinning-out unit 13 removes the 2nd, 4th, 6th, 8th, and 10th line spectra and the like.

In FIG. 4(*a*), the 1st, 3rd, 5th, 7th, and 9th line spectra and the like of those starting from the low-range side do not act as noise and therefore the signal levels thereof are 0 dB. On the other hand, the 2nd, 4th, 6th, 8th, and 10th line spectra and the like of those starting from the low-range side show signal levels other than 0 dB and therefore are detected as noise. For this reason, the thinning-out unit 13 removes the 2nd, 4th, 6th, 8th, and 10th line spectra and the like (line spectra except for the ($k\times2^1+1$)th line spectra) from the line spectra (frequency characteristics) shown in FIG. 4(*a*). In other words, the thinning-out unit 13 removes the line spectra indicating values other than 0 dB, that is, "low-level, varying line spectra" from the frequency characteristics, thereby obtaining frequency characteristics as shown in FIG. 4(*b*).

Figure 5A:
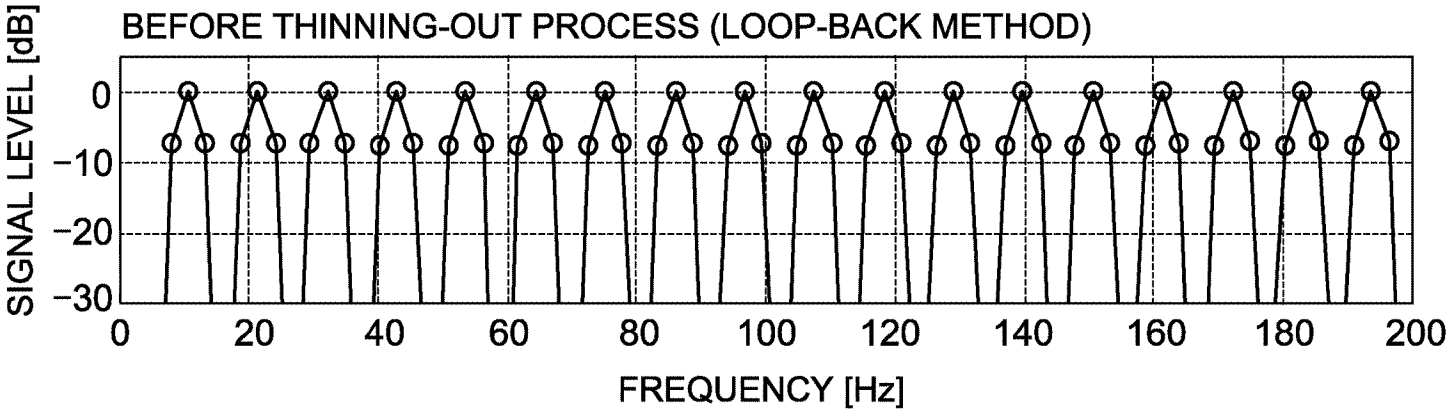
FIG. 5(*a*) shows a second example of frequency characteristics before the thinning-out unit according to the embodiment performs a thinning-out process, and FIG. 5(*b*) shows a second example of frequency characteristics after the thinning-out unit performs the thinning-out process.
Figure 5B:
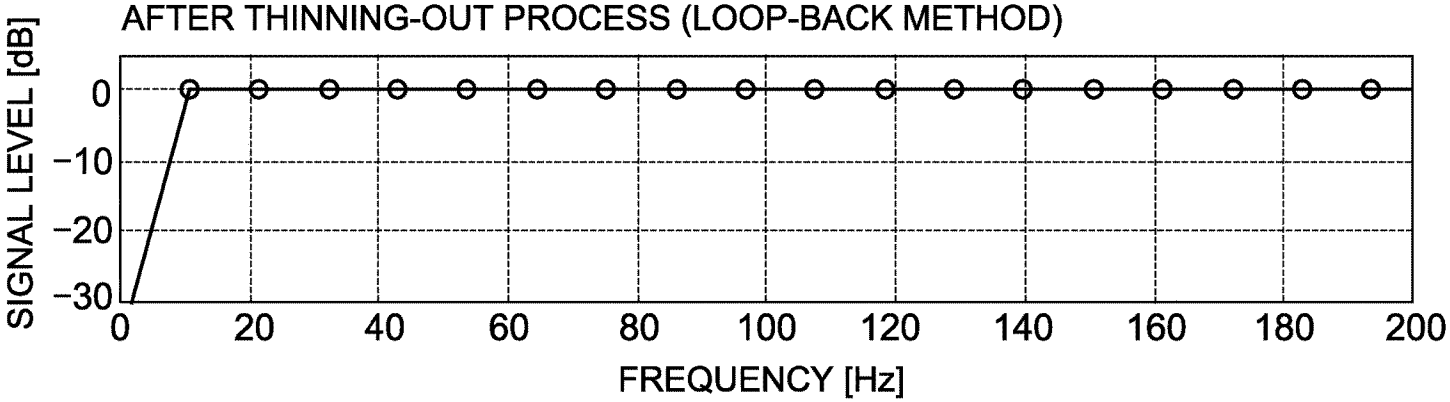

FIG. 5 includes diagrams showing line spectra (frequency characteristics) that the Fourier transform unit 12 obtained by Fourier transforming an m-sequence code having a length of 4,095 (n=12 in $2^n-1$) serving as a measurement signal using the loop-back method with the Fourier transform length set to 16,384 (m=14 in $2^m$). FIG. 5(*a*) shows frequency characteristics before the thinning-out unit 13 performed a thinning-out process; FIG. 5(*b*) shows frequency characteristics after the thinning-out unit 13 performed the thinning-out process.

In FIG. 5, n of the m-sequence code length is 12 (n=12), and m of the Fourier transform length is 14 (m=14). Therefore, $2^{m-n}=2^{14-12}2^2=4$. Accordingly, the thinning-out unit 13 removes line spectra except for the 1st, 5th, 9th, 13th, and 17th line spectra and the like of those starting from the low-range side in FIG. 5(*a*). In other words, the thinning-out unit 13 removes the 2nd, 3rd, 4th, 6th, 7th, 8th, 10th, 11th, 12th, 14th, 15th, and 16th line spectra and the like of those starting from the low-range side.

In FIG. 5(*a*), the 1st, 3rd, 5th, 9th, 13th, and 17th line spectra and the like of those starting from the low-range side do not act as noise and therefore the signal levels thereof are 0 dB. On the other hand, the 2nd, 3rd, 4th, 6th, 7th, 8th, 10th, 11th, 12th, 14th, 15th, and 16th line spectra and the like of those starting from the low-range side show signal levels other than 0 dB and therefore are detected as noise. For this reason, the thinning-out unit 13 removes line spectra except for the 1st, 5th, 9th, 13th, and 17th line spectra and the like (except for the ($k\times2^2+1$)th line spectra) from the line spectra shown in FIG. 5(*a*). In other words, the thinning-out unit 13 removes line spectra indicating values other than 0 dB (low-level, varying line spectra) from the frequency characteristics, thereby obtaining frequency characteristics as shown in FIG. 5(*b*).

As described above, the CPU 2 removes line spectra except for the ($k\times2^{m-n}+1$)th line spectra from the line spectra obtained by the Fourier transform process (S5 in FIG. 3; thinning-out step; thinning-out function). The thinned-out signals (frequency characteristics, line spectra) are outputted to the averaging unit 14.

Figure 6:
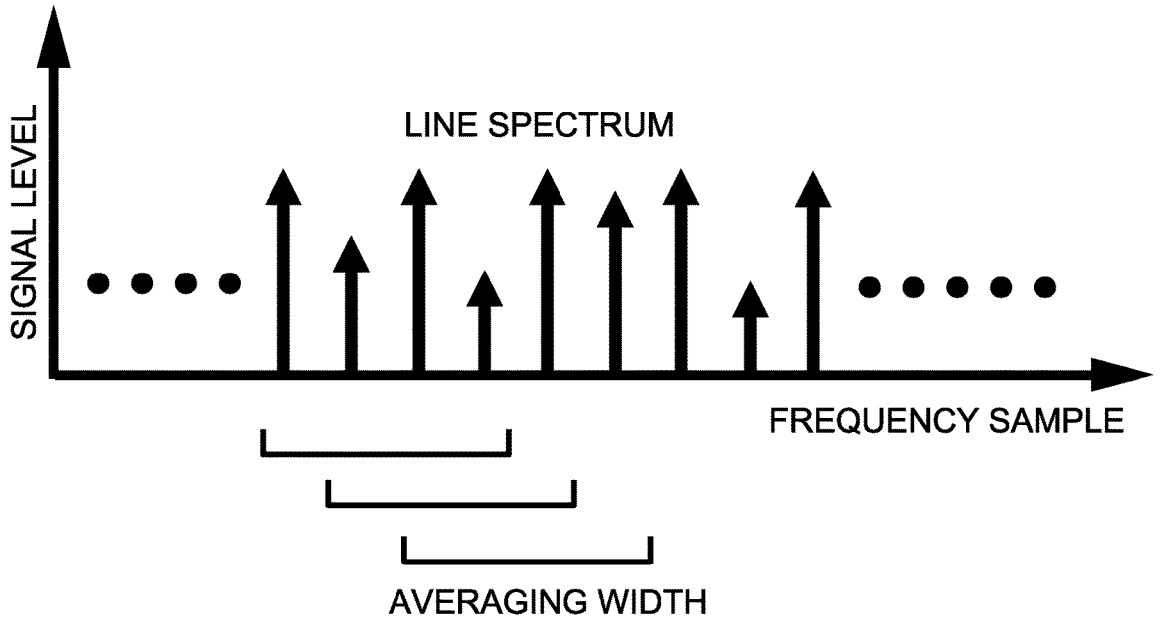
FIG. 6 is a diagram showing a process in which an averaging unit according to the embodiment calculates the average value of the signal levels of a predetermined number of samples in a thinned-out signal while shifting the predetermined number of samples in steps of one sample.

The averaging unit 14 has a function of calculating the average value of the thinned-out signals for each predetermined sample number. As shown in FIG. 6, the averaging unit 14 calculates the average value of the signal levels of a predetermined number of line spectra (a predetermined number of samples) of the line spectra of the thinned-out signal while shifting the predetermined number of line spectra from the low range toward the high range in steps of one line spectrum (in steps of one sample).

Figure 7:
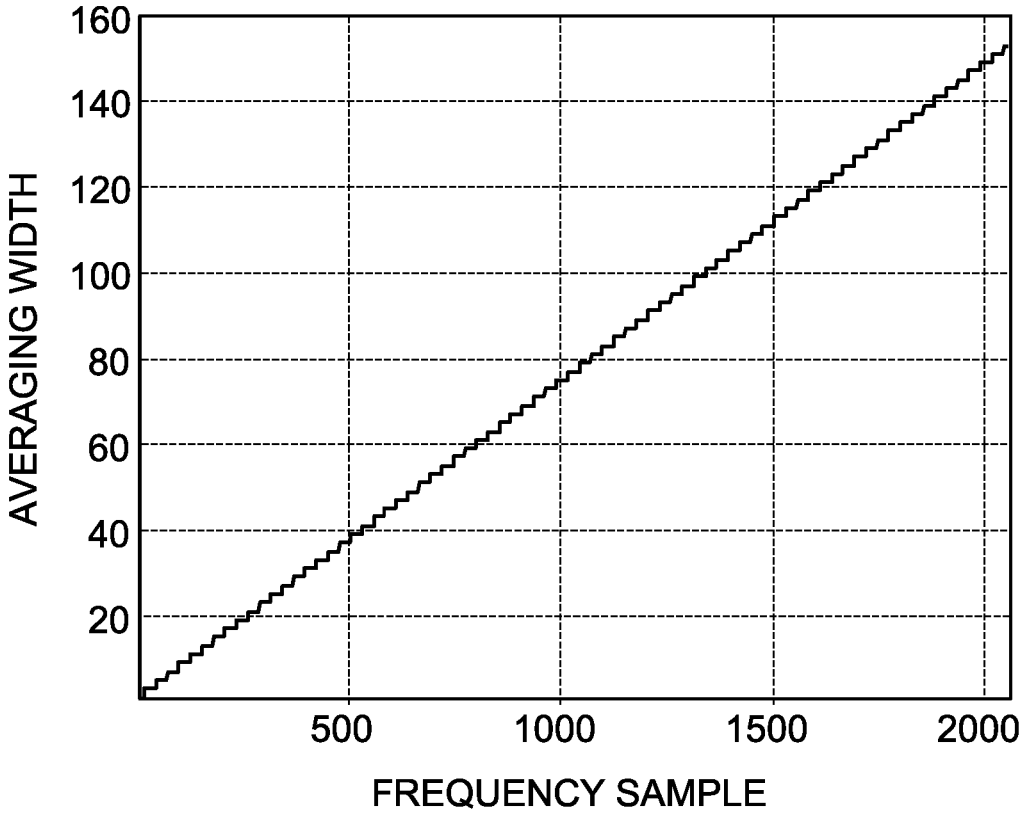
FIG. 7 is a diagram showing a sample number width (averaging width) for an averaging process set according to the number of frequency samples.

FIG. 7 is a diagram showing a sample number width for average value calculation (averaging width; predetermined frequency range) set in accordance with the number of frequency samples when shifting the predetermined number of line spectra in steps of one sample. In FIG. 7, the sample length of Fourier transform is 4,096, and the number of line spectra is 2,048. The number of frequency samples represented by the horizontal axis of FIG. 7 corresponds to the number of line spectra. As shown in FIG. 7, the predetermined number of samples for average value calculation (predetermined frequency range) varies with the number of frequency samples. That is, the averaging width is set such that the number of frequency samples is increased from the low range toward the high range. The CPU 2 calculates an average value with a 1/9 octave width by setting an averaging width as shown in FIG. 7. The resolution of the auditory sense is known to be about 1/3 octave. Since the averaging unit 14 sets an averaging width as shown in FIG. 7, the averaging process can be performed with sufficiently high resolution.

The CPU 2 averages the signal thinned out by the thinning-out unit 13 in the averaging unit 14 (S6 in FIG. 3; averaging step; averaging function) and outputs the averaged signal to the high-range amplifier unit 15.

The high-range amplifier unit 15 has a function of amplifying the signal levels of the high-range components of the averaged signal. When the thinned-out signal is averaged, the signal levels of the high-range components thereof tend to be attenuated. For this reason, the high-range amplifier unit 15 amplifies the signal levels of the high-range components using an inverted filter that considers the attenuated high-range components so that the signal levels of obtained frequency characteristics (line spectra) are flat (uniform). By amplifying the high-range components, it is possible to improve the measurement accuracy of the frequency characteristics of the high-range components.

The CPU 2 amplifies the high-range components of the averaged signal (S7 in FIG. 3) and outputs the resulting signal to the display unit 8. Note that the CPU 2 may output the frequency characteristics obtained by the Fourier transform unit 12 directly to the high-range amplifier unit 15 without thinning out the frequency characteristics in the thinning-out unit 13 and then may display the resulting frequency characteristics on the display unit 8. The display unit 8 receives the frequency characteristics (line spectra) and displays them on the display screen or the like thereof in accordance with an instruction of the CPU 2 so that the user can visually recognize the frequency characteristics (S8 in FIG. 3).

Figure 8A:
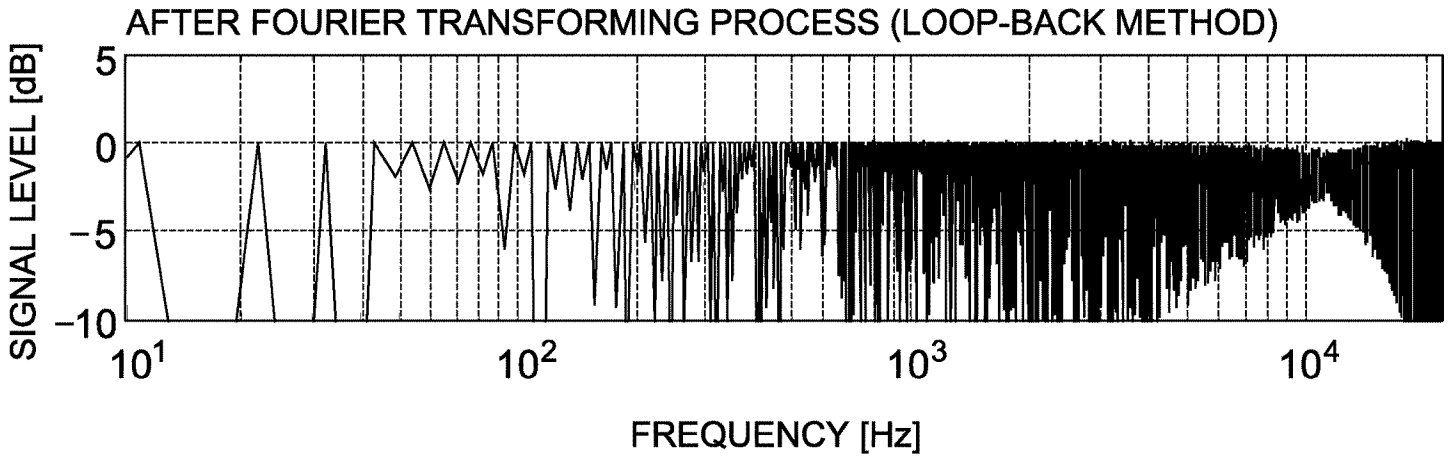
FIG. 8(*a*) shows frequency characteristics when a Fourier transform unit Fourier transformed an m-sequence code measured using a loop-back method, and FIG. 8(*b*) shows frequency characteristics when the thinning-out unit thinned out the frequency characteristics shown in FIG. 8(*a*)
Figure 8B:
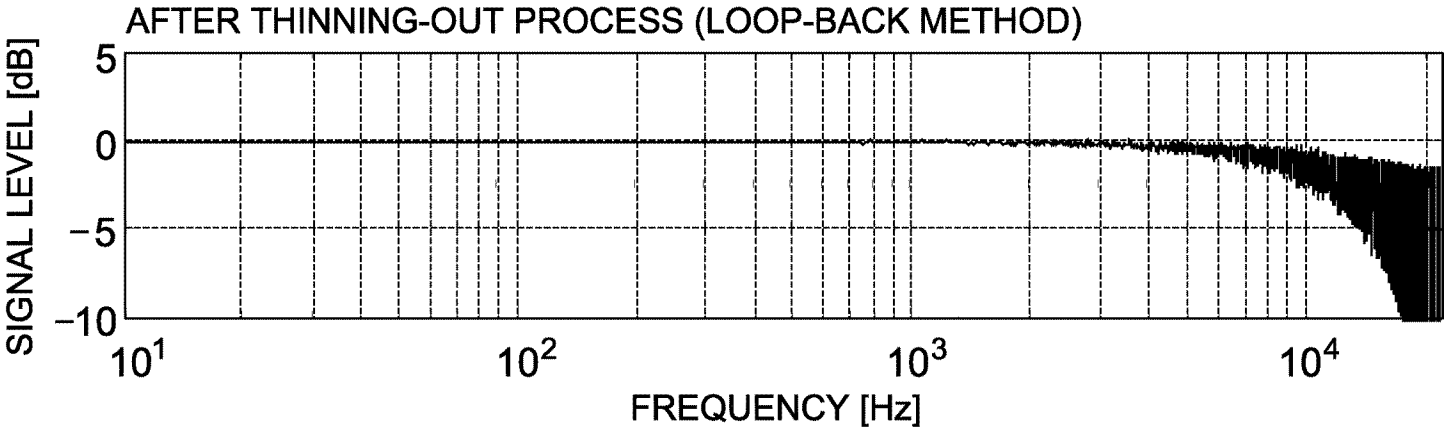
Figure 9A:
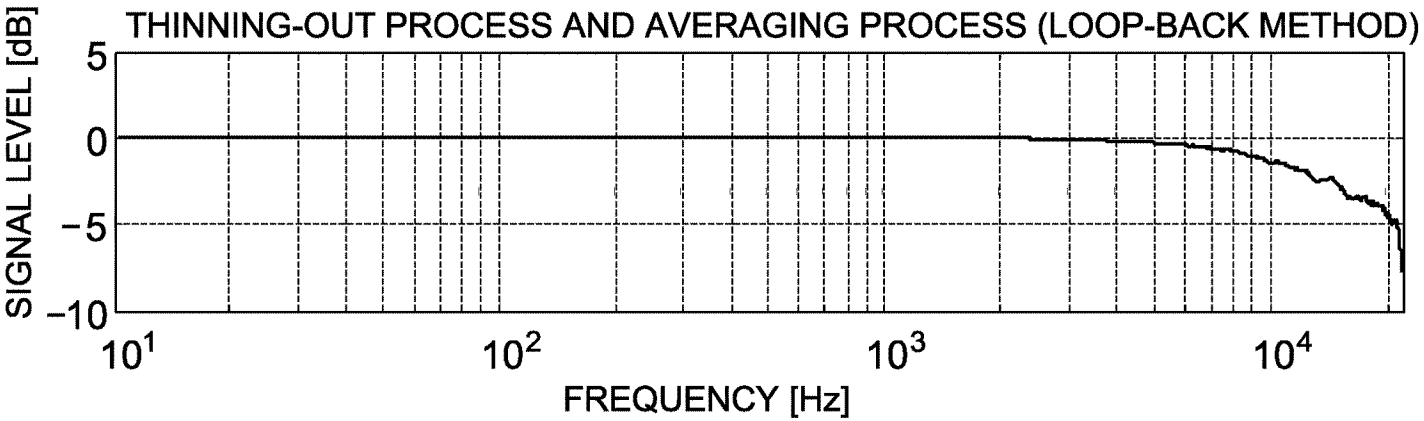
FIG. 9 includes diagram showing the frequency characteristics of the signal measured using the loop-back method and averaged by the averaging unit, in which FIG. 9(*a*) shows the frequency characteristics of the signal thinned out by the thinning-out unit and then averaged by the averaging unit.
Figure 9B:
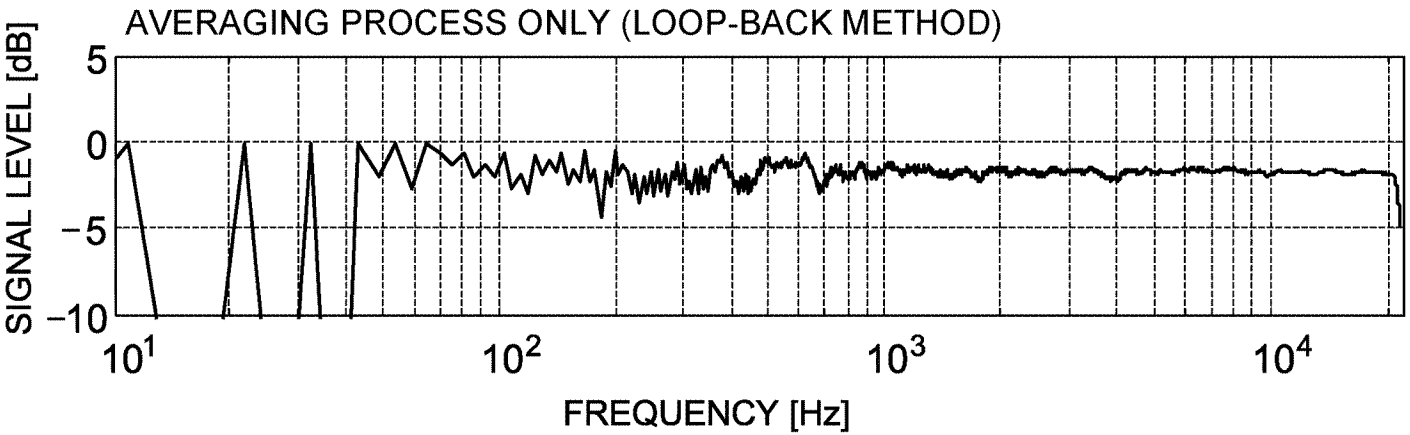
Figure 10A:
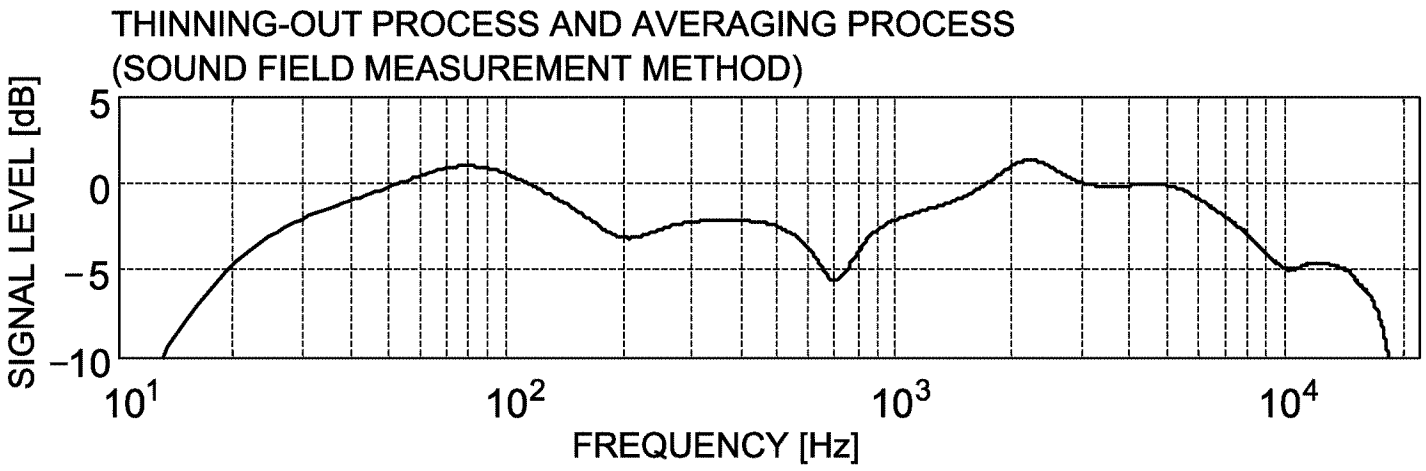
FIG. 10 includes diagrams showing the frequency characteristics of a signal measured using a sound field measurement method and then averaged by the averaging unit, in which FIG. 10(*a*) shows the frequency characteristics of a signal thinned out by the thinning-out unit.
Figure 10B:
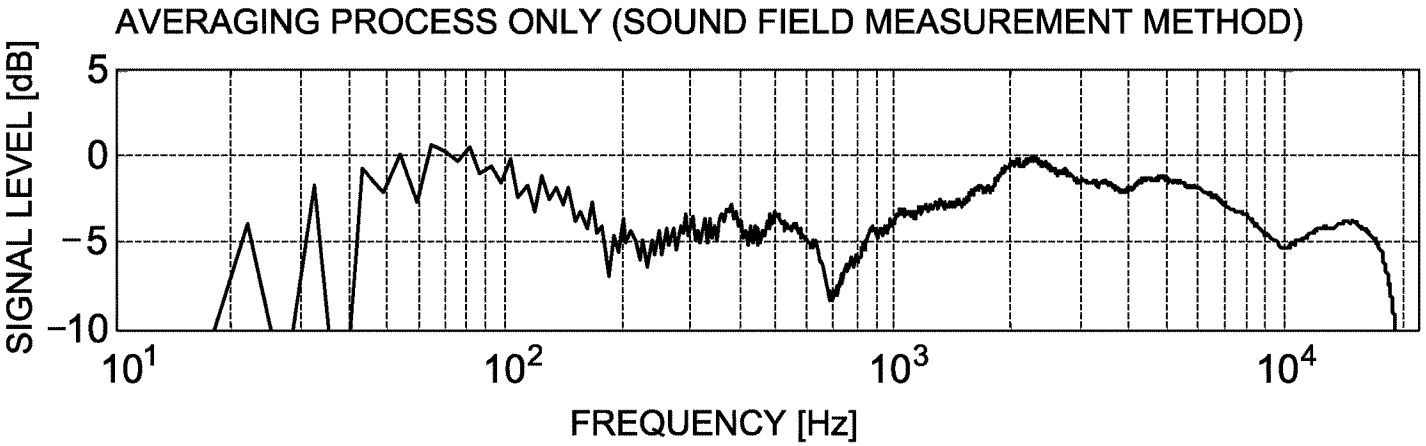

FIGS. 8 to 10 show specific examples of the measured frequency characteristics or the like. Using these examples, the process performed by the sound field measuring device 1 will be described. FIG. 8(*a*) shows frequency characteristics when the Fourier transform unit 12 Fourier transformed an m-sequence code measured using the loop-back method (Fourier-transformed frequency characteristics). FIG. 8(*b*) shows frequency characteristics when the thinning-out unit 13 thinned out the frequency characteristics shown in FIG. 8(*a*) (thinned-out frequency characteristics).

FIG. 9 includes diagram showing the frequency characteristics of the signal measured using the loop-back method and averaged by the averaging unit 14. FIG. 9(*a*) shows the frequency characteristics of the signal thinned out by the thinning-out unit 13 and then averaged by the averaging unit 14. FIG. 9(*b*) shows the frequency characteristics of the signal averaged by the averaging unit 14 without being thinning out. FIG. 10 includes diagrams showing the frequency characteristics of a signal measured using a method of measuring the frequency characteristics of a sound field by outputting a measurement signal from the speaker 9 and picking up measurement sound using the microphone 7 (hereafter referred to as the "sound field measurement method") and then averaged by the averaging unit 14. FIG. 10(*a*) shows the frequency characteristics of a signal thinned out by the thinning-out unit 13. FIG. 10(*b*) shows the frequency characteristics of a signal which was not thinned out.

The measurement conditions of the frequency characteristics shown in FIGS. 8 to 10 were as follows: an m-sequence code was used as a measurement signal; the sampling speed of the measurement signal was set to 44.1 kHz; the m-sequence code length was set to 4,095; the sample length of Fourier transform used by Fourier transform unit 12 was set to 8,192; the window function used by the Fourier transform unit 12 was set to a hamming window; and the averaging width used by the averaging unit 14 was set to a 1/9 octave.

When the length of an m-sequence code was set to 4,095 and the sample length of Fourier transform was set to 8,192, the sample length of Fourier transform was not an integral multiple of the length of the m-sequence code, that is, it was asynchronous therewith, as described above. For this reason, as shown in FIG. 8(*a*), low-level, varying line spectra occurred among the uniform line spectra at each Fourier transform. These line spectra showed signal levels other than 0 dB and were detected as noise. Further, an m-sequence code having a length of 4,095 was a measurement signal having a short code length. For this reason, the frequency intervals between the line spectra tended to be widened. In particular, the signal level significantly varied among the line spectra detected in the low-range components, and the envelop of the line spectra was not necessarily uniform.

On the other hand, as shown in FIG. 8(*b*), even when an m-sequence code having a short length is used as a measurement signal, if the thinning-out unit 13 removes low-level, varying line spectra, it is possible to suppress variations in the signal levels of the line spectra and to make the envelop of the line spectra in the low range uniform. In FIG. 8(*b*), variations in the signal levels were suppressed in a frequency range of 3,000 Hz or less, and the frequency characteristics were uniform. However, variations in the line spectra were shown in a frequency range of 3,000 Hz or more.

On the other hand, FIG. 9(*a*) shows frequency characteristics obtained by logarithmically averaging the thinned-out signal shown in FIG. 8(*b*). In FIG. 9(*a*), variations in the line spectra were suppressed not only in the low-mid range but also in a high range of 3,000 Hz or more.

FIG. 9(*b*) shows frequency characteristics of a signal which was logarithmically averaged without being thinned out. As shown in FIG. 9(*b*), even when the signal was averaged, if it was not sufficiently thinned out, variations in the signal levels could not be suppressed in the low-mid range. Thus, the measurement accuracy of the frequency characteristics significantly degraded. For this reason, when the thinning-out unit 13 thins out a signal, it is possible to remove low-level, varying line spectra in the low-mid range and thus to improve the measurement accuracy of the frequency characteristics. Further, by averaging the thinned-out signal, it is possible to effectively suppress variations in the line spectra in the high range.

Note that, as shown in FIG. 9(*a*), by thinning out the signal, the signal levels of the high-range components were reduced. However, by amplifying the high-range components in the high-range amplifier unit 15, it is possible to compensate for the amount of attenuation in the high range and to make the frequency characteristics of the measurement signal flat.

FIGS. 10(*a*) and 10(*b*) show frequency characteristics obtained using the sound field measurement method. In FIGS. 10(*a*) and 10(*b*), the frequency characteristics were measured by picking up measurement sound outputted from the speaker 9 using the microphone 7. This means that the frequency characteristics of the sound field (the sound field in the installation position of the microphone 7) were measured. In FIG. 10(*a*), the signal was thinned out and then averaged and thus variations in the signal levels in the low-mid range were effectively suppressed. In FIG. 10(*b*), the signal was averaged without being thinned out. Thus, variations in the signal levels in the low-mid range could not be suppressed, and the measurement accuracy of the frequency characteristics of the sound field significantly degraded.

As described above, in the sound field measuring device 1 according to the present embodiment, the thinning-out unit 13 thins out the line spectra obtained by the Fourier transform process. Thanks to this thinning-out process, it is possible to remove "low-level, varying line spectra," which result from the asynchronicity of the sample length of Fourier transform with the length of the m-sequence code, and thus to improve the measurement accuracy of the frequency characteristics.

In particular, when the code length of the measurement signal is $2^n-1$ and the sample length of Fourier transform is $2^m$, the thinning-out unit 13 removes line spectra except for the $(k\times2^{m-n}+1)$th line spectra. Thus, low-level, varying line spectra can be effectively removed.

Further, even when the measurement signal has a short code length and the frequency intervals between the line spectra (frequency spectra) of obtained frequency characteristics are wide, it is possible to effectively remove low-level, varying line spectra by thinning out the signal. Thus, even when a measurement signal having a short code length is used, it is possible to obtain frequency characteristics with a sufficient degree of measurement accuracy. It is also possible to reduce the measurement time or measurement load required to measure the frequency characteristics and to effectively reduce the amount of memory required for processing.

Further, by logarithmically averaging the signal, it is possible to suppress variations in the line spectra in all ranges and thus to further improve the measurement accuracy of the frequency characteristics of the sound field.

While the sound field measuring device, method, and program according to the embodiment of the present invention has been described in detail with reference to the drawings, the sound field measuring device, method, and program according to the present invention are not limited to the embodiment. Those skilled in the art would conceive of changes or modifications thereto without departing from the scope of claims, and such changes or modifications are to be construed as falling within the technical scope of the present invention.

In the above embodiment, there has been described the example in which all ranges of the frequency characteristics obtained by the Fourier transform process are thinned out. On the other hand, thinning out all ranges tends to reduce the signal levels of the high-range components. For this reason, the sound field measuring device 1 includes the high-range amplifier unit 15 for amplifying the reduced signal levels of the high-range components.

However, if only the low-mid range, which is significantly affected by low-level, varying line spectra, is thinned out, the need to amplify the signal levels of the high-range components would be reduced.

Figure 11:
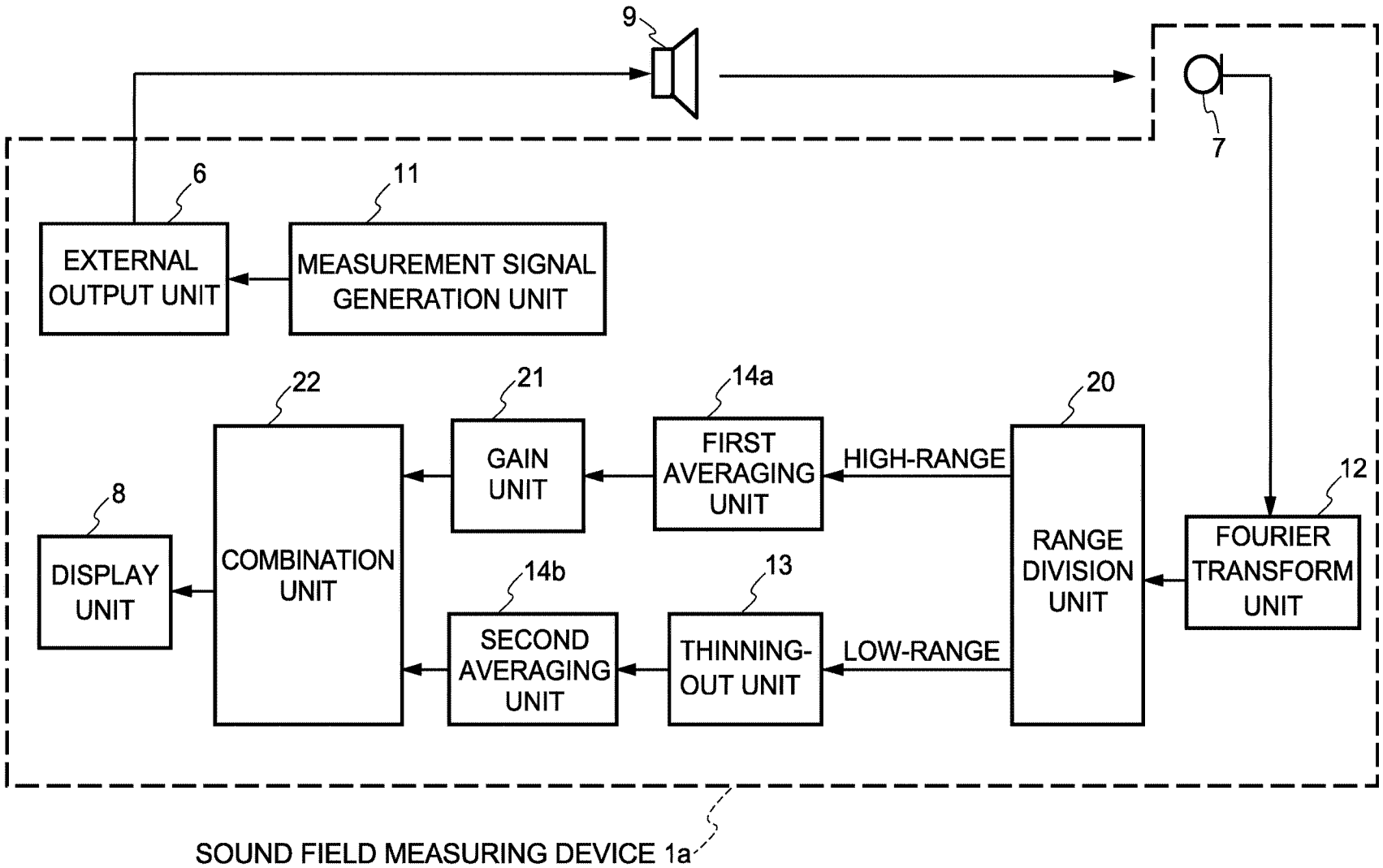
FIG. 11 is a block diagram showing a second schematic configuration of the function elements of a sound field measuring device when a CPU according to the embodiment measures frequency characteristics on the basis of the processing program.
Figure 12A:
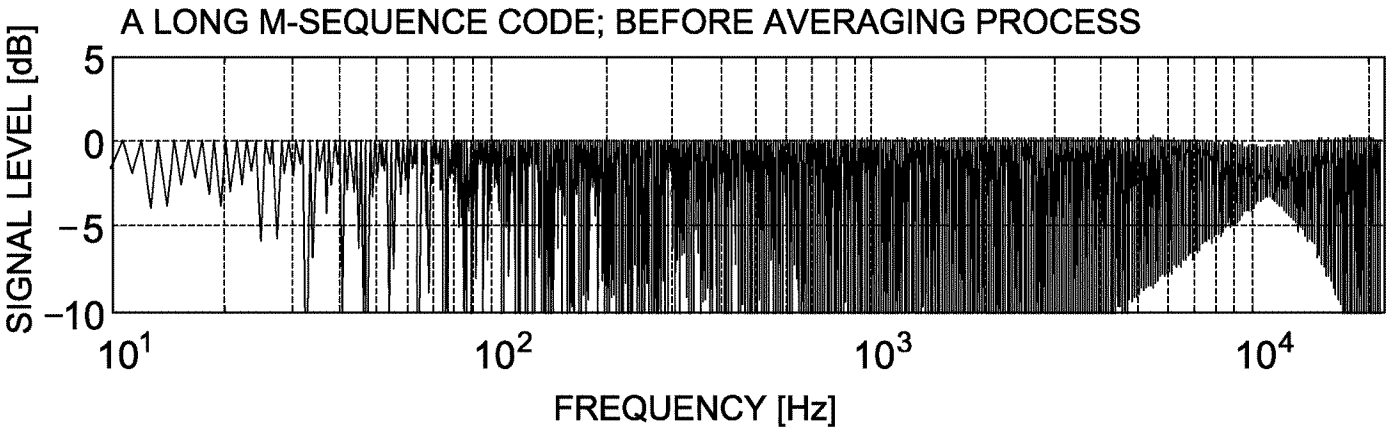
FIG. 12 includes diagrams showing an example of frequency characteristics obtained using a conventional sound field measuring device, in which FIG. 12(*a*) shows frequency characteristics when an m-sequence code having a code length of 32,767 was used.
Figure 12B:
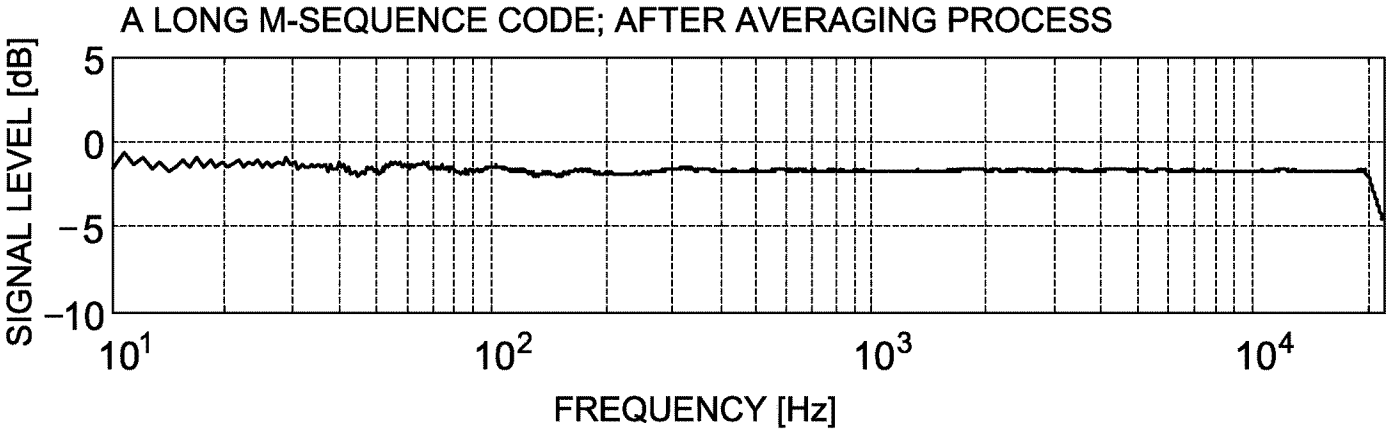
Figure 13A:
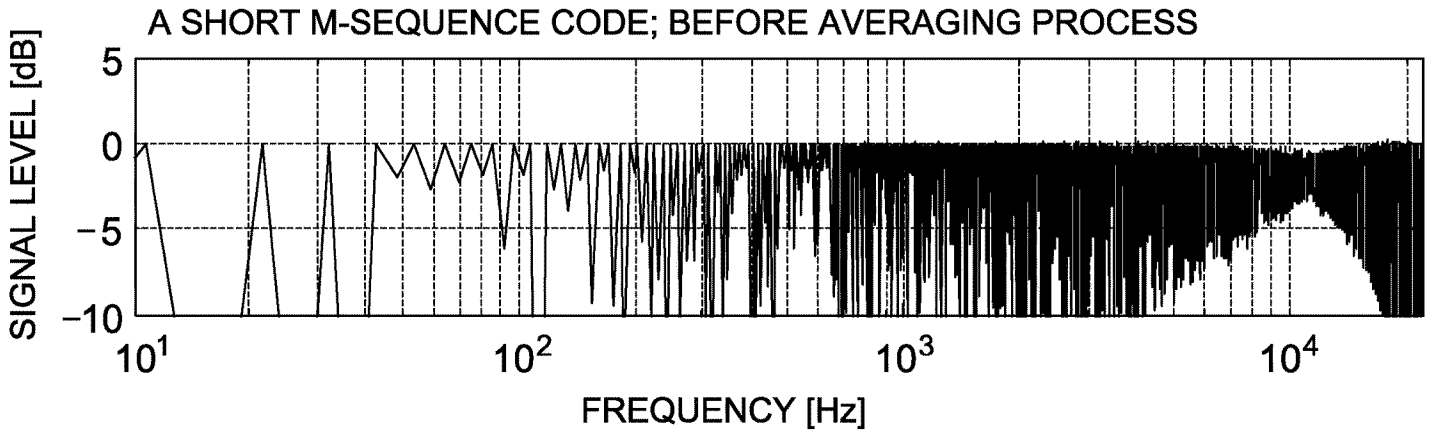
FIG. 13 includes diagrams showing an example of frequency characteristics obtained using a conventional sound field measuring device, in which FIG. 13(*a*) shows frequency characteristics when an m-sequence code having a code length of 4,096 was used.
Figure 13B:
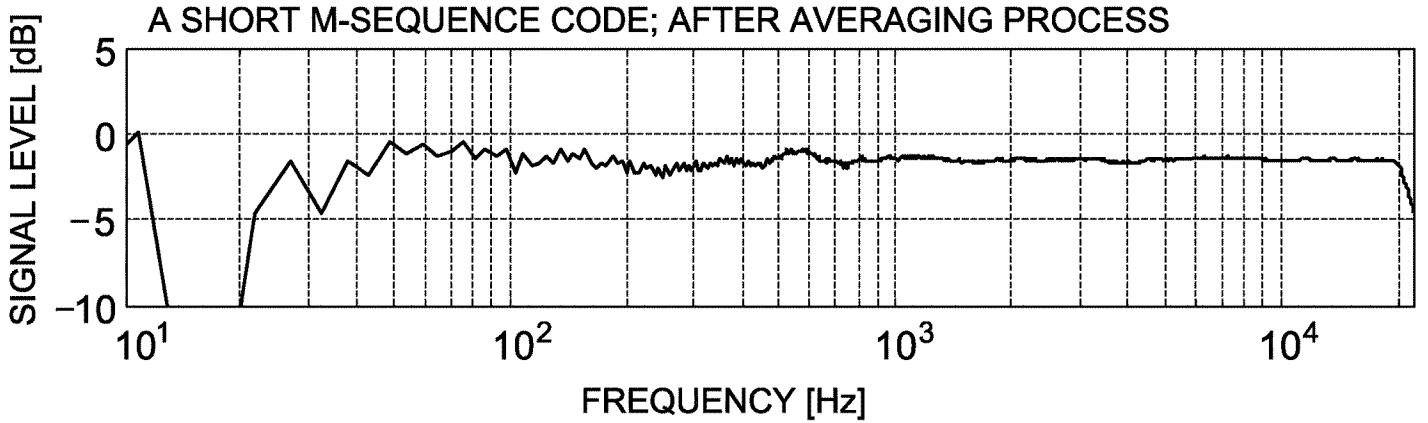

FIG. 11 is a diagram showing a schematic configuration of a sound field measuring device 1*a* according to another embodiment characterized in that the device 1*a* thins out only the low-range components of frequency characteristics obtained by a Fourier transform process and does not thin out the high-range components thereof. In FIG. 11, elements that perform processes similar to those performed by the elements shown in FIG. 2 are given the same reference signs. The sound field measuring device 1*a* shown in FIG. 11 differs from the sound field measuring device 1 shown in FIG. 2 in that the device 1*a* includes a range division unit 20, a gain unit 21, and a combination unit 22 but does not include the high-range amplifier unit 15 shown in FIG. 2. A first averaging unit 14*a* and a second averaging unit 14*b* shown in FIG. 11 are similar to the averaging unit 14 shown in FIG. 2 in that these elements average frequency characteristics.

In the sound field measuring device 1*a* shown in FIG. 11, the range division unit 20 has a function of dividing frequency characteristics obtained in a Fourier transform process by the Fourier transform unit 12 into frequency characteristics composed of high-range components and frequency characteristics composed of low-range components. In a division process, the range division unit 20 divides a signal received from the Fourier transform unit 12 into a signal having first frequency characteristics composed of the high-range components and a signal having second frequency characteristics composed of the low-range components using a predetermined frequency as the boundary (range division step; range division function). In this division process, the range is divided into the two ranges using the predetermined frequency value as the boundary not by using filters such as high-pass and low-pass filters but by performing digital processing or the like on the signal. Accordingly, the signal having the high-range frequency characteristics (first frequency characteristics) resulting from the division by the range division unit 20 has only the signal levels of frequencies higher than or equal to the predetermined frequency value; the signal having the low-range frequency characteristics (second frequency characteristics) resulting from the division by the range division unit 20 has only the signal levels of frequencies lower than or equal to the predetermined frequency value.

Only the low-range frequency characteristics (second frequency characteristics) resulting from the division are thinned out by the thinning-out unit 13 and averaged by the second averaging unit 14*b* (second averaging step; second averaging function). Thinning out only the low-range frequency characteristics (second frequency characteristics) allows for the avoidance of reductions in the signal levels of the high-range components which may result from the thinning-out process. The second averaging unit 14*b* generates averaged second frequency characteristics by calculating the average value of the signal levels in a predetermined second frequency range on the basis of the thinned-out low-range frequency characteristics (second frequency characteristics) while shifting the second frequency range in steps of a shorter frequency range than the second frequency range, for example, in steps of one sample.

On the other hand, the high-range frequency characteristics (first frequency characteristics) resulting from the division are averaged by the first averaging unit 14*a* without being thinned out (first averaging step; first averaging function). The resulting high-range frequency characteristics are gain-controlled by the gain unit 21 considering the difference in signal level with the second frequency characteristics. Since the high-range frequency characteristics (first frequency characteristics) are not thinned out, reductions in the signal levels of the high-range components due to the thinning-out process are avoided. This eliminates the need to provide the high-range amplifier unit 15 shown in FIG. 2.

The first averaging unit 14*a* generates averaged first frequency characteristics by calculating the average value of the signal levels in a predetermined first frequency range on the basis of the high-range frequency characteristics which have not been thinned out (first frequency characteristics) while shifting the first frequency range in steps of a shorter frequency range than the first frequency range, for example, in steps of one sample. The averaged first frequency characteristics are outputted to the gain unit 21.

The combination unit 22 generates frequency characteristics including signal components in all ranges by combining the high-range frequency characteristics gain-controlled by the gain unit 21 (averaged first frequency characteristics) and the low-range frequency characteristics (second frequency characteristics) averaged by the second averaging unit 14*b* (combination step; combination function). That is, the combination unit 22 generates all-range frequency characteristics whose low range is composed of the second frequency characteristics and whose high range is composed of the first frequency characteristics.

The frequency characteristics thus combined and generated are frequency characteristics in which only the low-range components have been thinned out and thus low-level, varying line spectra have been effectively reduced. Thus, it is possible to achieve frequency characteristics in which noise is suppressed in the low range. Since the high-range components are not thinned out, there is no need to amplify the high-range components after averaging. Thus, it is possible to obtain frequency characteristics with a sufficient degree of measurement accuracy.

As described above, in the sound field measuring device 1 according to the embodiment, the CPU 2 performs the functions of the function elements as shown in FIG. 2 on the basis of the processing program or application program stored in the ROM 3 or storage unit 5 as shown in FIG. 1. However, the number of CPUs which perform the functions of the function elements is not limited to one. For example, dedicated processing units (e.g., CPUs, chips, or the like dedicated to particular processing) for performing some functions of the function elements may be provided such that each dedicated processing unit performs at least one or more functions. Whether multiple dedicated processing units are provided or a single CPU performs a sound field measurement process on the basis of the processing program or the like, low-level, varying line spectra are removed by a thinning-out process and thus noise can be effectively reduced. Even when a measurement signal having a short code length is used, the frequency characteristics of the sound field environment can be accurately measured.

REFERENCE SINGS LIST

1, 1*a* sound field measuring device
2 CPU
3 ROM
4 RAM
5 storage unit
6 external output unit
7 microphone
8 display unit
9 speaker
11 measurement signal generation unit
12 Fourier transform unit
13 thinning-out unit
14 averaging unit
14*a* first averaging unit
14*b* second averaging unit
15 high-range amplifier unit
20 range division unit
21 gain unit
22 combination unit

The invention claimed is:

1. A sound field measuring device comprising:

an external output unit configured to output a measurement signal composed of a periodic function having a code length of $2^n-1$ to a speaker so that the measurement signal is outputted from the speaker;

a microphone configured to pick up the measurement signal outputted from the speaker;

a Fourier transform unit configured to obtain frequency characteristics by Fourier transforming measurement sound picked up by the microphone with a sample length of $2^m$ a thinning-out unit configured to remove noise from the frequency characteristics obtained by the Fourier transform unit by removing line spectra except for the $(k\times2^{m-n}+1)$th line spectra from the frequency characteristics; and an averaging unit configured to obtain averaged frequency characteristics of a sound field by calculating an average value of signal levels in a predetermined frequency range on the basis of frequency characteristics thinned out by the thinning-out unit while shifting the frequency range in steps of a shorter frequency range than the frequency range, wherein n and m are each a natural number satisfying m>n, and k is k=0, 1, 2, and the like.

2. The sound field measuring device according to claim 1, further comprising:

a range division unit configured to generate first frequency characteristics composed of high-range components and second frequency characteristics composed of low-range components by dividing a range of the frequency characteristics obtained by the Fourier transform unit; and a combination unit configured to obtain frequency characteristics of a sound field comprising signal components in all ranges by combining the first frequency characteristics and the second frequency characteristics, wherein the thinning-out unit removes noise from the second frequency characteristics generated by the range division unit by removing line spectra except for the $(k\times2^{m-n}+1)$th line spectra from the second frequency characteristics, and the averaging unit comprises:

a first averaging unit configured to generate averaged first frequency characteristics by calculating an average value of signal levels in a predetermined first frequency range on the basis of the first frequency characteristics generated by the range division unit while shifting the first frequency range in steps of a shorter frequency range than the first frequency range; and a second averaging unit configured to generate averaged second frequency characteristics by calculating an average value of signal levels in a predetermined second frequency range on the basis of the second frequency characteristics thinned out by the thinning-out unit while shifting the second frequency range in steps of a shorter frequency range than the second frequency range, and the combination unit obtains frequency characteristics of a sound field comprising signal components in all ranges by combining the first frequency characteristics averaged by the first averaging unit and the second frequency characteristics averaged by the second averaging unit.

3. A method for measuring a sound field using a sound field measuring device, comprising:

an external output step in which an external output unit outputs a measurement signal composed of a periodic function having a code length of $2^n-1$ to a speaker so that the measurement signal is outputted from the speaker;

a sound pick-up step in which the measurement signal outputted from the speaker in the external output step is picked up using a microphone;

a Fourier transform step in which a Fourier transform unit obtains frequency characteristics by Fourier transforming measurement sound picked up using the microphone in the sound pick-up step with a sample length of $2^m$;

a thinning-out step in which a thinning-out unit removes noise from the frequency characteristics obtained in the Fourier transform step by removing line spectra except for the $(k\times2^{m-n}+1)$th line spectra from the frequency characteristics; and an averaging step in which an averaging unit obtains averaged frequency characteristics of a sound field by calculating an average value of signal levels in a predetermined frequency range on the basis of frequency characteristics thinned out in the thinning-out step while shifting the frequency range in steps of a shorter frequency range than the frequency range, wherein n and m are each a natural number satisfying m>n, and k is k=0, 1, 2, and the like.

4. The method according to claim 3, further comprising:

a range division step in which a range division unit generates first frequency characteristics composed of high-range components and second frequency characteristics composed of low-range components by dividing a range of the frequency characteristics obtained in the Fourier transform step; and a combination step in which a combination unit obtains frequency characteristics of a sound field comprising signal components in all ranges by combining the first frequency characteristics and the second frequency characteristics, wherein the thinning-out step comprises the thinning-out unit removing noise from the second frequency characteristics generated in the range division step by removing line spectra except for the $(k\times2^{m-n}+1)$th line spectra from the second frequency characteristics, and the averaging unit comprises a first averaging unit and a second averaging unit, the averaging step comprises:

a first averaging step in which the first averaging unit generates averaged first frequency characteristics by calculating an average value of signal levels in a predetermined first frequency range on the basis of the first frequency characteristics generated in the range division step while shifting the first frequency range in steps of a shorter frequency range than the first frequency range; and a second averaging step in which the second averaging unit generates averaged second frequency characteristics by calculating an average value of signal levels in a second frequency range on the basis of the second frequency characteristics thinned out in the thinning-out step while shifting the second frequency range in steps of a shorter frequency range than the second frequency range, and the combination step comprises the combination unit obtaining frequency characteristics of a sound field comprising signal components in all ranges by combining the first frequency characteristics averaged in the first averaging step and the second frequency characteristics averaged in the second averaging step.

5. A sound field measuring program executed by a sound field measuring device for measuring frequency characteristics of a sound field using a measurement signal composed of a periodic function having a code length of $2^n-1$, the program causing a computer of the sound field measuring device to perform:

an external output function of outputting a measurement signal composed of a periodic function having a code length of $2^n-1$ to a speaker so that the measurement signal is outputted from the speaker;

a sound pick-up function of picking up the measurement signal outputted from the speaker by the external output function using a microphone;

a Fourier transform function of obtaining frequency characteristics by Fourier transforming measurement sound picked up by the sound pick-up function with a sample length of $2^m$;

a thinning-out function of removing noise from the frequency characteristics obtained by the Fourier transform function by removing line spectra except for the $(k\times2^{m-n}+1)$th line spectra from the frequency characteristics; and an averaging function of obtaining averaged frequency characteristics of a sound field by calculating an average value of signal levels in a predetermined frequency range on the basis of frequency characteristics thinned out by the thinning-out function while shifting the frequency range in steps of a shorter frequency range than the frequency range, wherein n and m are each a natural number satisfying m>n, and k is k=0, 1, 2, and the like.

6. The sound field measuring program according to claim 5, the program causing the computer of the sound field measuring device to further perform:

a range division function of generating first frequency characteristics composed of high-range components and second frequency characteristics composed of low-range components by dividing a range of the frequency characteristics obtained by the Fourier transform function; and a combination function of obtaining frequency characteristics of a sound field comprising signal components in all ranges by combining the first frequency characteristics and the second frequency characteristics, wherein the thinning-out function comprises a function of removing noise from the second frequency characteristics generated by the range division function by removing line spectra except for the $(k\times2^{m-n}+1)$th line spectra from the second frequency characteristics, and the averaging function performs:

a first averaging function of generating averaged first frequency characteristics by calculating an average value of signal levels in a predetermined first frequency range on the basis of the first frequency characteristics generated by the range division function while shifting the first frequency range in steps of a shorter frequency range than the first frequency range; and a second averaging function of generating averaged second frequency characteristics by calculating an average value of signal levels in a predetermined second frequency range on the basis of the second frequency characteristics thinned out by the thinning-out function while shifting the second frequency range in steps of a shorter frequency range than the second frequency range, and the combination function performs a function of obtaining frequency characteristics of a sound field comprising signal components in all ranges by combining the first frequency characteristics averaged by the first averaging function and the second frequency characteristics averaged by the second averaging function.

* * * * *